US006712228B2

(12) United States Patent
Lowe

(10) Patent No.: US 6,712,228 B2
(45) Date of Patent: Mar. 30, 2004

(54) MOUNTABLE HANGER APPARATUS AND KIT OF PARTS THEREFORE

(76) Inventor: Richard B. Lowe, 5515 Rosslyn Ave., Indianapolis, IN (US) 46220

( * ) Notice: Subject to any disclaimer, the term of this patent is extended or adjusted under 35 U.S.C. 154(b) by 0 days.

(21) Appl. No.: 10/066,903

(22) Filed: Feb. 4, 2002

(65) Prior Publication Data

US 2003/0146179 A1 Aug. 7, 2003

(51) Int. Cl.[7] ..... A47F 5/08
(52) U.S. Cl. ..... 211/119.004; 211/96; 211/87.01
(58) Field of Search ..... 211/87.01, 96, 211/119.004, 58, 95, 70, 115, 116, 165

(56) References Cited

U.S. PATENT DOCUMENTS

| | | | | | |
|---|---|---|---|---|---|
| 496,173 | A | * | 4/1893 | Smith | 211/96 |
| 914,697 | A | | 3/1909 | Bryant | |
| 1,435,110 | A | | 11/1922 | Efford | |
| 1,818,761 | A | | 8/1931 | Sendler | |
| 1,837,692 | A | | 10/1931 | Thomas | |
| 2,176,723 | A | | 10/1939 | Sauer | |
| 2,270,802 | A | | 1/1942 | Kristensen | |
| 2,561,806 | A | | 7/1951 | Mailland | |
| 2,595,521 | A | | 5/1952 | Hanson | |
| 2,633,997 | A | | 4/1953 | Johnson | |
| 2,684,225 | A | | 7/1954 | Johnson | |
| 2,732,161 | A | | 1/1956 | Moriarty | |
| 2,895,698 | A | | 7/1959 | Palmer | |
| 3,044,630 | A | | 7/1962 | Szabo | |
| 3,175,696 | A | | 3/1965 | Milbourne | |
| 3,825,127 | A | | 7/1974 | Morrison | |
| 4,721,212 | A | | 1/1988 | Lowe | |
| 4,763,855 | A | * | 8/1988 | DiVincenzo | 211/115 |
| 5,085,389 | A | | 2/1992 | Levesque | |
| 5,772,050 | A | * | 6/1998 | Shih | 211/163 |
| 5,897,086 | A | | 4/1999 | Condon | |
| 6,196,398 | B1 | | 3/2001 | Lowe | |
| 6,206,210 | B1 | * | 3/2001 | Reed | 211/96 |
| D450,200 | S | * | 11/2001 | Lowe | D6/411 |

* cited by examiner

*Primary Examiner*—Jerry Redman
*Assistant Examiner*—Erica B. Harris

(57) ABSTRACT

Mountable hanger apparatus and a kit of parts therefore for affixing preferably to door hinges. The hanger apparatus comprises an elongated member having top, intermediate, and bottom segments, all of which are longitudinally interconnectable along the axis of the elongated member. Each intermediate segment has end portions each directly interconnectable both rotatably and longitudinally with an end portion of a remaining segment. Preferably, each segment includes a tubular member having a passageway extending therethrough. All but the bottom end segment has one end portion swaged to a reduced diameter for insertion into an unswaged end portion of another tubular member. Resultantly, each intermediate segment can swivel or rotate independent of the top and bottom end segments. Support arms are fixedly attachable to each of the segments of the elongated member, and mounting brackets are fixedly attachable to the top and bottom end segments.

20 Claims, 5 Drawing Sheets

MOUNTABLE HANGER APPARATUS AND KIT OF PARTS THEREFORE

FIELD OF THE INVENTION

This invention relates to a hanger apparatus that is mountable on a door, frame, wall, hinges, and the like and, in particular, to mountable hanger apparatus in which the support arms can swivel or rotate independent of each other and a kit of parts therefore.

BACKGROUND OF THE INVENTION

Individuals are often searching for additional space in their homes to hang articles of clothing (such as coats, towels and other articles) due to the lack of closet space or overcrowded closets or simply for organization or ease of access in a specific location.

Many prior art devices designed for attachment to or supported by door hinges for the placement and storage of articles have been proposed. Early devices were designed to be clamped onto hinge pins of the hinges of doors for supporting storage and holding devices such a clothes drying racks, as evidenced by U.S. Pat. No. 2,595,521 to Hanson. However, as shown in the Hanson structure, the clothes drying rack was only useful in supporting small articles. A more recent device shown by U.S. Pat. No. 2,684,225 to Johnson is designed to be clamped on the ends of door hinges for support of an elongated rod which has a plurality of support racks extended therefrom for supporting clothes hangers, shelves, tie racks, and other appliances and devices. However, the Johnson device is designed to be attached to the door hinge by clamping a support bracket, shown in FIG. 2, around each end of the door hinge pin, and, therefore, cannot support very much weight.

A still further device is shown in U.S. Pat. No. 3,175,696 to Milbourne, which replaces the door hinge pin itself with an extended end portion of a support frame. Simplified versions of door hinge pin supported devices are shown in U.S. Pat. No. 2,270,802 to Kristensen and U.S. Pat. No. 3,044,630 to Szabo.

Although each of the foregoing prior art devices discloses article hangers and article storage devices designed to be supported by or as a replacement for door hinge pins to store articles behind a door, each of the prior art devices presents certain drawbacks to their use. For example, the Hanson and Johnson devices cannot support any significant weight, due to the fact that they have been designed to clamp over the ends of the door hinge pins. The device disclosed by Milbourne cannot support a great amount of weight, due to the fact that the longitudinal axis of the main support bar is spaced a great distance from the longitudinal axis of the hinge pins thereby reducing its rigidity. The early prior art devices of Kirstensen and Szabo present small singular hook devices that only provide for a minimal amount of storage for support of a minimal number of articles.

One solution to the need for extra hanging space is disclosed in my previous U.S. Pat. No. 4,721,212 entitled "Modular Article Support Unit" issued on Jan. 26, 1988. This patent discloses a modular article support unit comprising an elongated tubular member adapted to be removably attached to the hinge pins of a door by means of adjustable brackets. Said elongated tubular member having a plurality of holes along the length thereof for removably attaching several different types of support devices such as coat hooks, towel racks, bulletin boards, and mirrors. While this invention has adequately served the need for hanging space for several years, there are some disadvantages with the same. For example, the modular article support unit must be mounted in a fixed location, i.e., in the hinges of a door. This limits an individual's ability to locate the support unit in any desired location. Further, the support devices attached to the support unit are likewise limited in that they are fixedly mounted thereto.

Another solution to the need for extra hanging space is disclosed in another patent of mine U.S. Pat. No. 6,196,398, entitled "Hanger Apparatus and Method of Mounting the Same" issued on Mar. 6, 2001. The hanger apparatus comprises two end poles each having an angled mounting bracket attached thereto. Mounted between each end pole is a plurality of middle poles or spacers and a plurality of hanger bars pivotally mounted between the end poles and middle poles. The angled brackets of the end poles are situated in such a manner to allow flexibility and ease in mounting the hanger apparatus in a door jam or door frame at any location along the door frame and along either side of the door frame without interfering with the use of the door. The angled brackets further allow the hanger apparatus to be mounted to a wall. This hanger apparatus is flexible in mounting, as well as easy to mount. The hanger apparatus also has independently movable hanger bars. Although this hanger apparatus serves the user well, one drawback is that it contains a multitude of parts for the user to assemble.

SUMMARY OF THE INVENTION

The foregoing problems are solved and a technical advance is achieved in an illustrative embodiment of mountable hanger apparatus and a kit of parts therefore of the present invention in which the number of parts needed to be assembled is advantageously reduced over that of its predecessor. Furthermore, the direct interconnection of the hanger apparatus segments provides a sturdy construct in which the article support arms can swivel or rotate independent of each other. The mountable hanger apparatus comprises an elongated member have a longitudinal axis, a first end segment, at least one intermediate segment (preferably two or more), and a second end segment. Advantageously, all of the segments are directly interconnectable both longitudinally and rotatably along the longitudinal axis with an end portion of a remaining one of the segments. This advantageously eliminates the need for separate interconnecting parts of the prior art devices and maintains the structural integrity of the hanger apparatus, while permitting at least the intermediate segments to swivel or rotate about the longitudinal axis independent of the end segments.

A support arm is fixedly attachable to each intermediate segment and radially extendable from the longitudinal axis for hanging various articles thereon. A support arm can be fixedly attached to each of the first and second end segments as well.

A first mounting bracket is attachable to the first end segment and has a first portion for affixing preferably and rotatably about a hinge pin of a door hinge. Although, the first portion of the first mounting bracket can be readily adapted for attachment directly to a door, window, frame, wall, and the like.

A second mounting bracket is attachable to the second end segment and has a first portion, like the first mounting bracket, for affixing preferably and rotatably about an other hinge pin of an other door hinge. Most often the hinges of a door are in vertical alignment, which allows for the elongated member of the hanger apparatus to be swiveled or rotated about the vertical axis established by the door hinge pins. This advantageously permits the mountable hanger apparatus to be rotated or swiveled so as not to interfere with the use of the door to which it is attached. As before, the first portion of the second mounting bracket can be readily adapted for attachment in concert with the first mounting bracket directly to a door, window, frame, wall, and the like.

As a result, the mountable apparatus of the present invention can be directly interconnected, whereby each of the intermediate segments and an accompanying support arm are advantageously rotatable about the longitudinal axis of the elongated member independent of the end segments when each of the end segments is attached to, for example, a wall, door, frame, hinge, and the like.

To facilitate the direct longitudinal interconnection of the segments, one end portion of each interconnectable pair of end portions has an outside cross-sectional dimension for insertion into a passageway in the other end portion of the interconnectable pair of end portions. This is advantageously manifested when each of the segments of the elongated member comprises a tubular member having a wall, a passageway extending longitudinally therethrough, and accompanying inside and outside cross-sectional dimensions such as, for example, the inside and outside diameters of the nominally sized tubular member. At least one end portion of an interconnectable pair of end portions of interconnectable segments has either an enlarged cross-sectional dimension such as an enlarged inside diameter larger than the outside cross-sectional dimension (outside diameter) of the interconnectable pair to rotatably receive the other end portion of the pair in the passageway of the at least one end portion. Alternatively, the at least one end portion of an interconnectable pair has a reduced cross-sectional dimension such as a reduced or swaged outside diameter that is smaller than the inside cross-sectional dimension (inside diameter of the tubular member) to rotatably receive the at least one end portion of the pair in the passageway of the other end portion.

In a simple and cost effective form, one end portion of each interconnectable pair of an elongated tubular member has a reduced outside diameter for insertion into the passageway of the other end portion of an interconnectable pair. From a manufacturing standpoint, the elongated member of the mountable hanger apparatus is formed from a plurality of tubes having nominal inside and outside diameters of which one end of each tube, except the bottom tube, is swaged to a smaller outside diameter for insertion into the passageway of an unswaged end portion of another tube. Advantageously, the interconnected end portions of a pair of tubes provide for direct longitudinal interconnection without the need for additional interconnecting parts and that is rotatable about the longitudinal axis of the elongated member.

In another aspect of the invention, a portion, preferably horizontal, of each mounting bracket has an opening therein for insertion of a door hinge pin therethrough for pivotal attachment to a door hinge. Each mounting bracket is preferably L-shaped and has another portion, preferably vertical, having a slot therethrough for inserting a fastener therethrough and attaching the mounting bracket to an end segment. The slot in one or both of the brackets advantageously permits the hanger apparatus to be mounted on a pair of door hinges that can have a wide range of spacing therebetween.

For mounting the hanger apparatus on other than a pair of hinges, each of the mounting brackets each includes first and second sections having a predetermined angle therebetween in a range from 30 degrees to 150 degrees.

The present invention also includes a kit of mountable hanger apparatus parts as previously and hereinafter described.

In another aspect of the present invention, the interconnectable parts of the hanger apparatus are interconnected for affixing to at least one of a wall, door, frame, hinge and the like.

DETAILED DESCRIPTION

Figure 1:
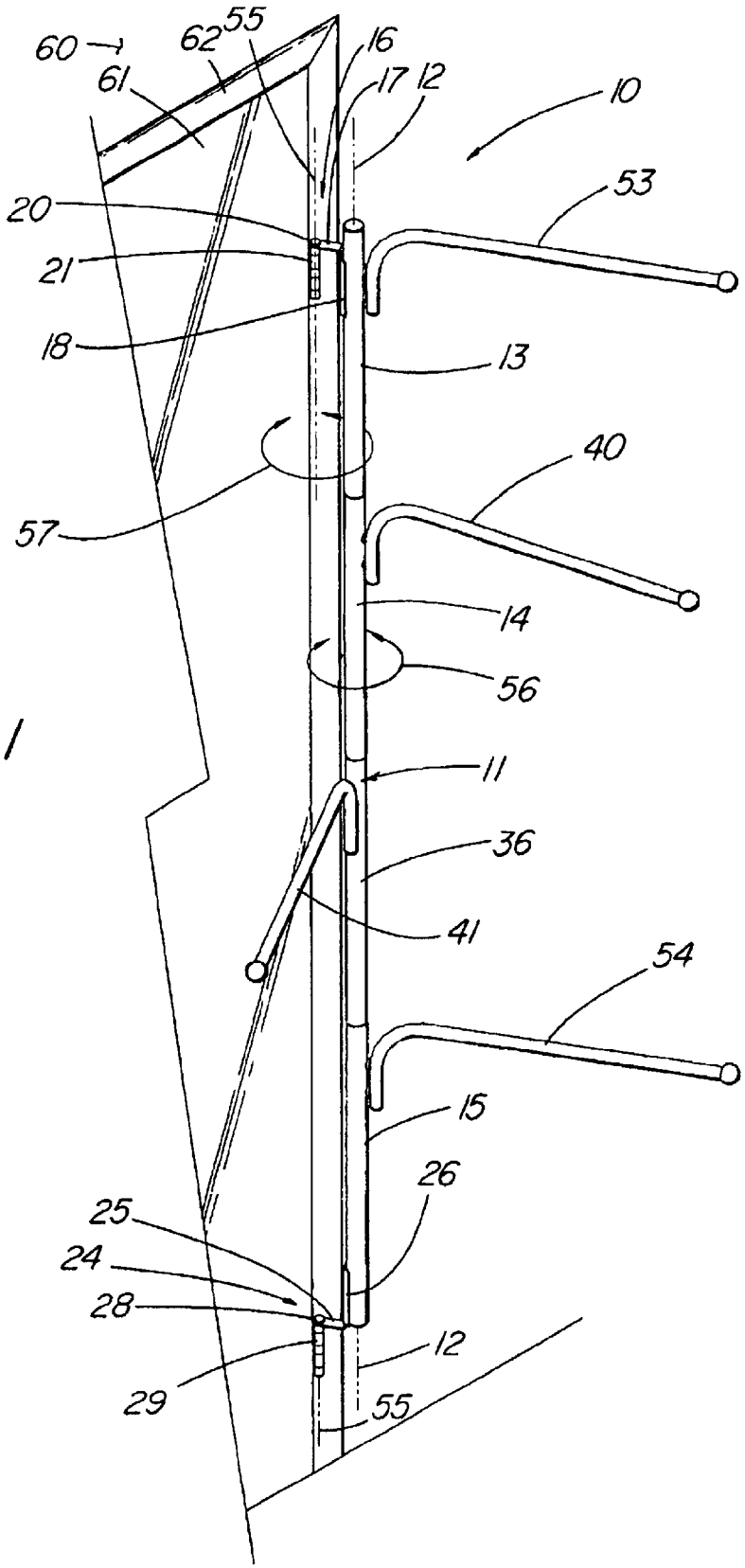
FIG. 1 depicts a pictorial view of a preferred illustrative embodiment of mountable hanger apparatus of the present invention mounted on door hinges.

FIG. 1 depicts a pictorial view of a preferred illustrative embodiment of mountable hanger apparatus 10 of the present invention mounted on door hinges 21 and 29, which are positioned between door 61 and doorframe 62 in wall 60. The hanger apparatus comprises an elongated member 11 having a longitudinal axis 12. The elongated member further includes a first or top end segment 13 and a second or bottom end segment 15. The elongated member still further includes at least one intermediate segment 14 and preferably an other intermediate segment 36 which are disposed between end segments 13 and 15. All of the end and intermediate segments are directly interconnectable along longitudinal axis 12. A support arm 40 is fixedly attachable to intermediate segment 14 and radially extendable from the longitudinal axis for hanging articles of, for example, clothing or towels thereon. Other support arms 41 are fixedly attachable to other intermediate segments 36. Support arms 53 and 54 are fixedly attachable and radially extendable from top end segment 13 and bottom end segment 15, respectively. Other embodiments of supports such as hooks, tie/towel racks, grid support, mirror or bulletin/blackboard assemblies or frames that are attachable to the segments of the elongated member are contemplated and disclosed in U.S. Pat. No. 4,721,212 of mine and incorporated by reference herein. Each of the intermediate segments along with its accompanying support arm are rotatable about longitudinal axis 12 independent of top and bottom end segments 13 and 15 when each of the end segments is attached to at least one of a wall, door, frame, hinge, and the like. Top and bottom end segments can swivel or rotate only about longitudinal axis 55 established by the vertical alignment of door hinge pins 20 and 28.

First or top mounting bracket 16 is attachable to first end segment 13. The first mounting bracket is preferably L-shaped and includes a first, preferably horizontal, portion 17 extending radially from the hanger apparatus for rotatably affixing the top end segment to door hinge 21. The horizontal mounting bracket portion 17 has an opening extending therethrough through which door hinge pin 20 is inserted. Similarly, a second mounting bracket 24 is attachable to bottom end segment 15. Second mounting bracket 24 is preferably L-shaped and has a horizontal portion 25 extending radially from the bottom end segment for rotatably affixing the bottom end segment 15 to second door hinge 29. Horizontal mounting bracket portion 25 has an opening extending therethrough for inserting a second door hinge pin 28 therethrough. Other vertical portions 18 and 26 of respective first and second L-shaped mounting brackets 16 and 24 have vertical slots therein for inserting fasteners therethrough and attaching the mounting bracket to the end segment. In this particular embodiment and indicated by rotational arrows 57, elongated member 11 of the hanger apparatus and, in particular, the top and bottom end segments 13 and 15 along with intermediate segments 14 and 36 are rotatable about longitudinal axis 55 that is established by vertically aligned door hinge pins 20 and 28. However in addition as indicated by rotational arrows 56, intermediate segments 14 and 36 are also rotatable about longitudinal axis 12 of the elongated member independent of each other and, more importantly, end segments 13 and 15 for positioning articles on support arms 40 and 41 in a variety of positions about hanger apparatus 10.

As normally would be expected, top and bottom door hinges 21 and 29 are positioned between door 61 and doorframe 62. As described in U.S. Pat. No. 4,721,212 and incorporated by reference herein, first and second mounting brackets 16 and 24 are attached to door hinges 21 and 29 of which the spacing therebetween can vary from one door to another. This variable spacing between door hinges is accommodated by the slots in the mounting brackets as well as the positioning of the mounting brackets with respect to the elongated member 11. Although mounting brackets 16 and 24 are preferably for rotatable attachment to door hinges, the radially extendable portion of each mounting bracket can readily be adapted for direct attachment to a door, frame, wall, and the like as described in my U.S. Pat. No. 6,196,398 and incorporated by reference herein.

Figure 2:
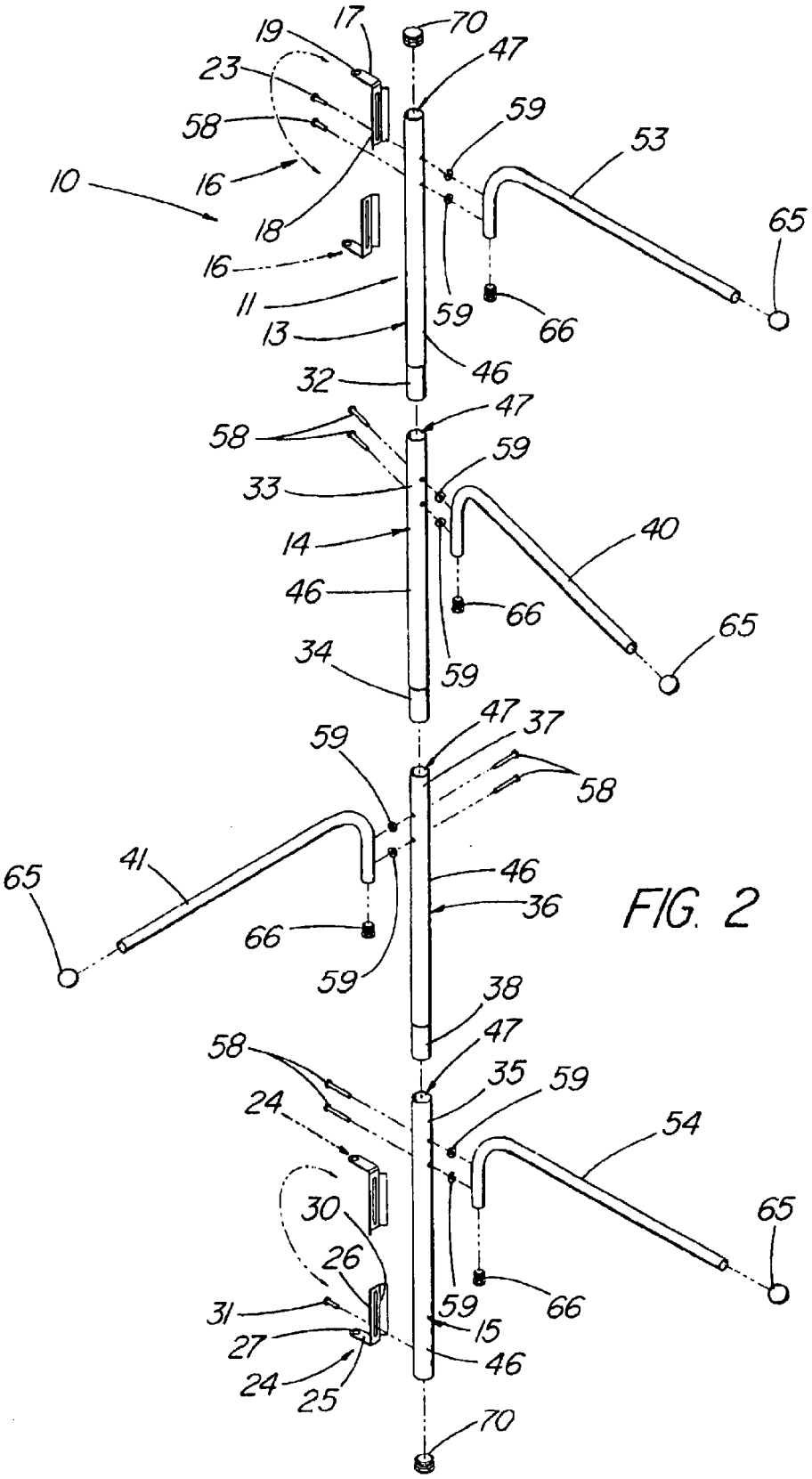
FIG. 2 depicts an exploded view of the mountable hanger apparatus of FIG. 1.

FIG. 2 depicts an exploded view of the mountable hanger apparatus 10 of FIG. 1. In this exploded view, essentially all of the parts of the mountable hanger apparatus are depicted. Any combination of all or any of these parts can be included in a kit of mountable hanger apparatus parts, which forms another aspect of the present invention. Elongated member 11 comprises a plurality of tubular, directly interconnectable segments 13–15 and 36. Each of the segments comprises a tubular member 46 having a passageway 47 extending longitudinally therethrough. By way of example, top end segment 13, intermediate segment 14, and other intermediate segment 36 each comprises an approximately 1.00 inch outside diameter 22 gauge cold rolled commercial quality metal tube approximately 17.25 inches in length. For appearance purposes, epoxy paint is applied to the surface thereof. At approximately 2.375 and 3.875 inches from the top end of each tubular segment, an approximately 0.221 inch hole is drilled through both walls of the tube to facilitate the insertion of 1.5"×#10 pan head screws 23 or 58 therethrough and attach a support arm to the tubular segment. Well-known plastic spacer washers 59 are positioned between the tubular segment and support arm. The other end of each tubular member has a reduced outside diameter end portion that extends longitudinally for approximately two inches from the bottom end. The outside diameter through this end portion is typically reduced using a well-known swaging process to approximately 0.930 inches. This swaged end portion comprises end portion 32 of top end segment 13, second end portion 34 of intermediate segment 14 and second end portion 38 of other intermediate segment 36. These reduced outside diameter end portions are longitudinally insertable directly into the other end portion of an interconnectable pair of end portions of the tubular segments. In particular, reduced diameter end portion 32 and first end portion 33 of intermediate segment 14 comprise one interconnectable pair of end portions. Reduced outside diameter end portion 34 and first end portion 37 of other intermediate segment 36 forms a second interconnectable pair of end portions. Likewise, reduced outside diameter end portion 38 and top end portion 35 of bottom end segment 15 forms an interconnectable pair of end portions.

Figure 3:
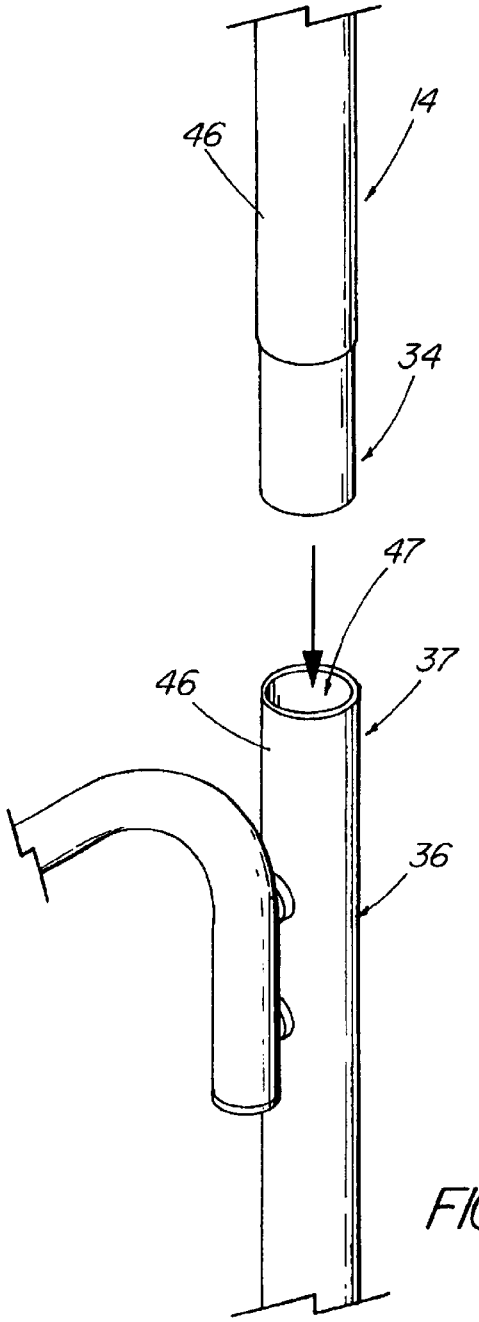
FIG. 3 depicts an enlarged pictorial view of unconnected intermediate segments of the mountable hanger apparatus of FIG. 2.

FIG. 3 depicts an enlarged pictorial view of unconnected tubular members 46 of intermediate segment 14 and other intermediate segment 36 of FIG. 2. For that matter, this figure depicts the interconnectablity of the end portions of any interconnectable pair of tubular segments. Reduced outside diameter end portion 34 is depicted for insertion into passageway 47 of end portion 37.

Figure 4:
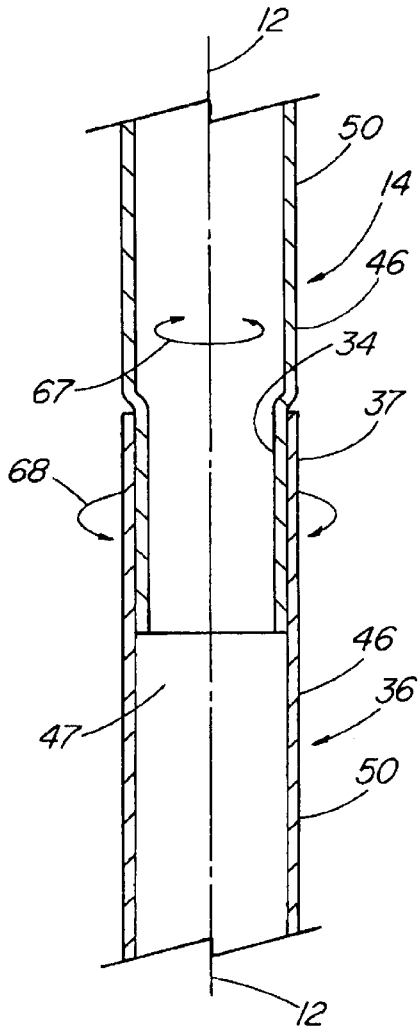
FIG. 4 depicts an enlarged cross-sectional view of interconnected intermediate segments of the mountable hanger apparatus of FIG. 3.

FIG. 4 depicts an enlarged cross-sectional view of interconnected intermediate segment 14 and other intermediate segment 36 of FIG. 3. Reduced outside diameter end portion 34 has been inserted into passageway 47 of end portion 37 of other intermediate segment 36. As indicated by rotational arrows 67 and 68, intermediate segment 14 and other intermediate segment 36 are rotatable about longitudinal axis 12 of the elongated member independent of the top and bottom end segments 13 and 15. End portion 37 of other intermediate portion 36 extends for approximately 2.00 inches from the top end of other intermediate segment 36. The end portions of each segment likewise extend for approximately 2.00 inches. As also depicted in FIG. 4, tubular members 46 each have a wall 50 of approximately 0.025-inch thickness extending longitudinally therealong.

Figure 5:
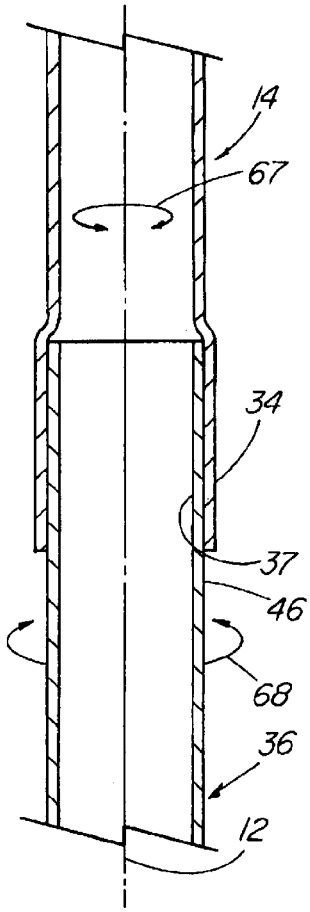
FIG. 5 depicts an alternative embodiment of interconnected end portions of the intermediate segments of FIG. 4.

FIG. 5 depicts an alternative embodiment of end portions 34 and 37 of intermediate segments 14 and 36 of FIG. 4. In this alternative embodiment, the inside and outside diameters of end portion 34 have been enlarged to receive the nominal 1.00-inch outside diameter of tubular member 46 and, in particular, end portion 37 of other intermediate segment 36. Likewise in this alternative embodiment, the intermediate segments are directly interconnected longitudinally and rotatably about longitudinal axis 12 of the elongated member independent of end segments 13 and 15. As depicted in FIGS. 4 and 5, the directly and longitudinally interconnectable end portions of the intermediate segments form male and female members that are insertable and interconnectable with female and male members of interconnectable pairs of end portions.

Returning to FIG. 2, bottom end segment 15 comprises a similar approximately 17.25 inch tubular member 46 of approximately 1.00 inch outside diameter 22 gauge cold rolled commercial quality metal tube. Approximately 2.75 and 3.875 inches from the top end of the tube, an approximate 0.221 inch hole is drilled through the tube for affixing support arm 54 to the bottom end segment with fasteners 58 and plastic spacer washers 59 as previously described. Approximately 1.25 inches from the bottom end of segment 15, an approximately 0.140 inch hole is drilled through only one side of the tube for inserting a 0.5"×#10 Phillips head screw 31 through elongated slot 30 of vertical portion 26 of L-shaped second mounting bracket 24 and into bottom end segment 15. Second mounting bracket 24 also includes horizontal portion 25 with opening 27 extending therethrough for Positioning a door hinge pin through the opening. As alternatively depicted, second mounting bracket 24 can be positioned with horizontal portion 25 above vertical portion 26 to accommodate variable spacing between door hinges. A one-inch large flat end plastic cap 70 is inserted into the bottom end of passageway 47 of bottom end segment 15. Likewise, a large flat end plastic cap 70 is inserted into the top end of top end segment 13.

First mounting bracket 16 is depicted with vertical portion 18 having elongated slot 22 therein and a horizontal portion 17 with opening 19 extending therethrough for insertion of a door hinge pin. Fastener 23 is inserted through slot 22 and through the top hole extending through both sides of top end segment 13, spacer 59 and into support arm 53. A second fastener 58, which is similar to fastener 23, is inserted through the bottom holes of the top end segment, spacer 59 and into support arm 53. Similar to second mounting bracket 24, first mounting bracket 16 has an alternative position with horizontal portion 17 below vertical portion 18 to again accommodate variable spacing encountered between door hinges.

Support arms 40,41,53, and 54 each comprise an approximate 21-inch length of approximate 0.265 inch outside diameter 22-gauge cold rolled commercial quality metal tube. Each L-shaped support arm includes a long leg of approximately 17.500 inch and a short leg approximately 5.00 inches interconnected by a radiused bend of approximately 2.50 inches. Approximately 0.750 and 2.250 inches from the short leg end of the support arm, two approximately 0.140 inch holes are drilled through the outside portion of the short leg for insertion of pan head screws 58 therein with plastic spacer washers 59 positioned between the short leg of the support arm and the various segments of the elongated member of the hanger apparatus. A one-inch plastic ball end cap 65 is positioned at the end of the long leg of each support arm. A ⅝-inch plastic flat end cap 66 is positioned at the end of the short leg of each support arm.

Figure 6:
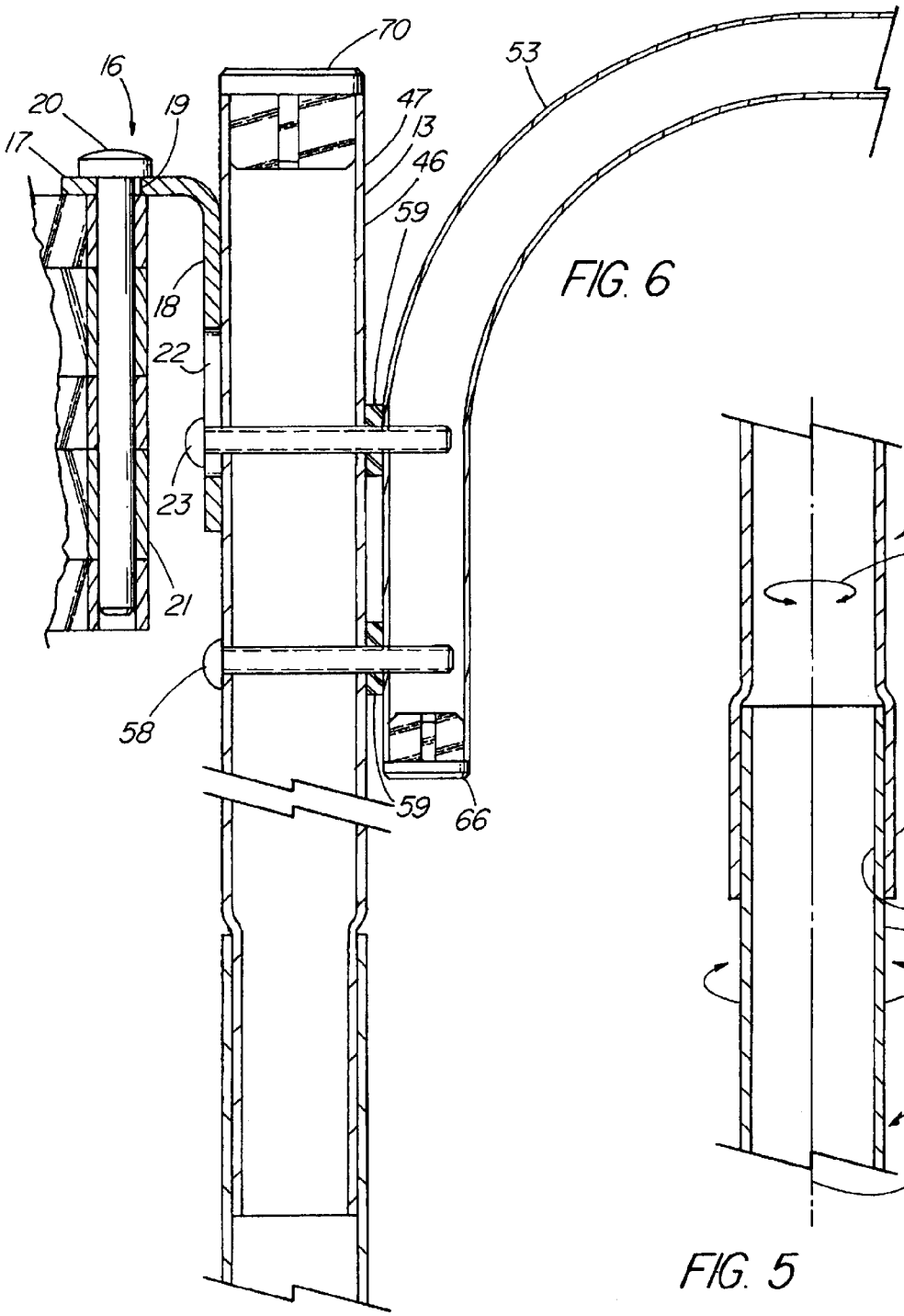
FIG. 6 depicts an enlarged, cross-sectional view of the top end segment of the mountable hanger apparatus of FIG. 1 with a support arm extending from the top end segment and connecting to a door hinge.

FIG. 6 depicts an enlarged, cross-sectional view of the interconnection of support arm 53 to top end segment 13, which in turn is connected to door hinge 21 and door hinge pin 20 of FIG. 1. Mounting bracket 16 includes a horizontal portion 17 with opening 19 with door hinge pin 20 extending through the opening and into door hinge 21. Vertical portion 18 includes slot 22 of which fastener 23 extends through the slot tubular member 46, plastic spacer washer 59 and into the short leg of support arm 53. Another fastener 58 extends directly through tubular member 46 through another plastic spacer washer 59 and into the short leg of support arm 53. Flat end cap 66 is inserted into the short leg of support arm 53, whereas large plastic flat end cap 70 is inserted into passageway 47 at the top end of top end segment 13.

Figure 7:
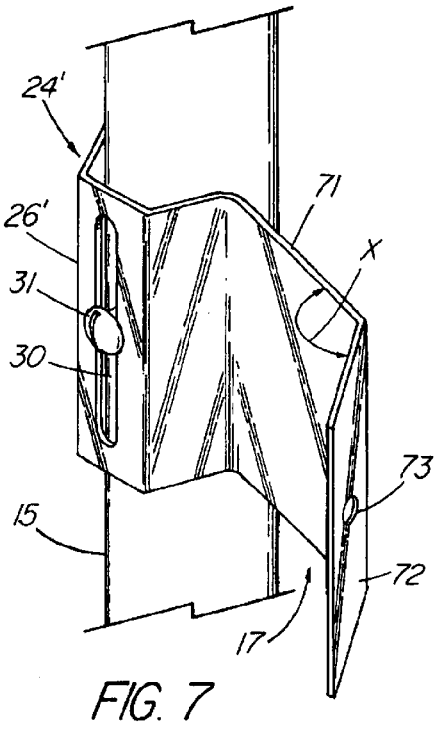
FIG. 7 depicts a pictorial view of an alternative illustrative embodiment of the mounting bracket of the mountable hanger apparatus of the present invention.

FIG. 7 depicts a pictorial view of an alternative illustrative embodiment of the mounting bracket of the present invention. Mounting bracket 24' is secured to bottom end segment 15 of the hanger apparatus with bracket fastener 31 inserted through slot 30 and secured to bottom end segment 15. The first portion of the mounting bracket includes horizontal sections 71 and 72 having a predetermined angle X therebetween. Predetermined angle X can range from 30 degrees to 150 degrees. The preferred angle X between first and second horizontal sections 71 and 72 is approximately 135 degrees such that when the angled first portion is mounted to a wall the bottom end segment and the attached portion of the bracket extend away from the wall at an angle of approximately 45 degrees. Opening 73 in end horizontal section 72 of the bracket is for affixing the bracket to a wall using, for example, a well-known woodscrew.

Figure 8:
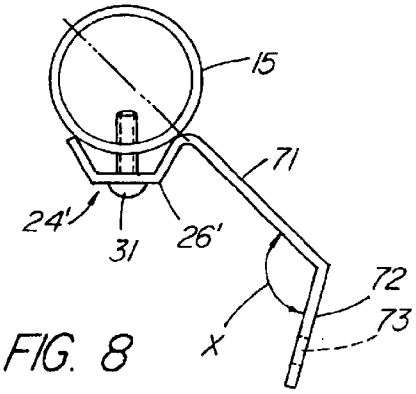
FIG. 8 depicts a bottom view of the bottom end segment and mounting bracket attached thereto of the mountable hanger apparatus of FIG. 7.

FIG. 8 depicts a bottom view of the bottom end segment 15 and second mounting bracket 24' attached thereto of FIG. 7. Fastener 31 is depicted securing second mounting portion 26' of mounting bracket 24' to bottom end segment 15 with horizontal angled sections 71 and 72 extending there-from. Angle X is again shown as the predetermined angle between the angle bracket sections.

Figure 9:
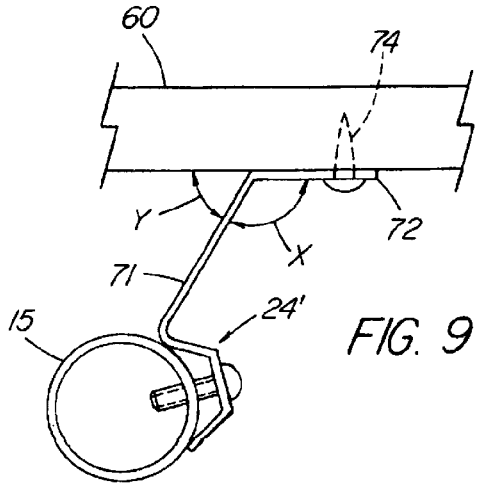
FIG. 9 depicts a bottom view of the bottom end segment of the mountable hanger apparatus of FIG. 8 attached to a wall.

FIG. 9 depicts a bottom view of bottom end segment 15 of the mountable hanger apparatus of FIG. 8 attached to wall 60 using, for example, woodscrew 74. When attached, the bottom end segment of the hanger apparatus extends away from wall 60 at an angle of approximately 45 degrees (angle Y)

Figure 10:
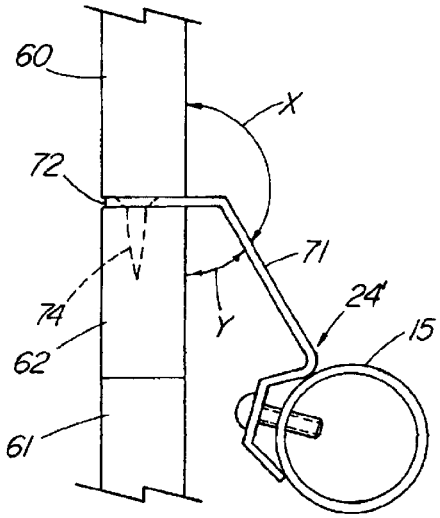
FIG. 10 depicts a bottom view of bottom end segment of the mountable hanger apparatus of FIG. 8 attached to a doorframe.

FIG. 10 depicts a bottom view of bottom end segment 15 of FIG. 8 attached to doorframe 62. Doorframe 62 is positioned between wall 60 and door 61. End section 72 of the bracket is now perpendicular to the wall and doorframe and is attached to the doorframe by means of wood screw 74. Predetermined angles X and Y are once again maintained with respect to the surface of the wall so that the bracket and hanger apparatus extend away from the wall at an angle of approximately 45 degrees.

Although the mountable hanger apparatus has been herein described as both a kit of parts and an interconnected apparatus, it is to be understood that the present invention includes either a kit of parts dissembled or interconnected. Furthermore, a kit of mountable hanger apparatus parts is included as any combination of the afore-mentioned parts.

List of Parts for Mountable Hanger Apparatus

10 Mountable hanger apparatus
11 Elongated member
12 Longitudinal axis of 11
13 First or top end segment of 11
14 Intermediate segment of 11
15 Second or bottom end segment of 11
16 First or top mounting bracket of 13
17 Horizontal portion of 16
18 Other portion of 16 (Vertical)
19 Opening in 17
20 First or top door hinge pin through 19
21 First or top door hinge
22 Slot of 18
23 Top bracket fastener
24 Second or bottom mounting bracket of 15
25 Horizontal portion of 24
26 Other portion of 24 (Vertical)
27 Opening of 25
28 Second or bottom door hinge pin through 27
29 Second or bottom door hinge
30 Slot of 26
31 Bottom bracket fastener

32 End portion of 13
33 First end portion of 14
34 Second end portion of 14
35 End portion of 15
36 Other intermediate segment
37 First end portion of 36
38 Second end portion of 36
39 Predetermined angle
40 Support arm of 14
41 Other support arm of 36
42 Male member of 14
43 Female member of 14
44 Interconnectable female member of 13, 15
45 Interconnectable male member of 13, 15
46 Tubular member of 13–15
47 Longitudinal passageway of 46
48 Inside cross-sectional dimension of 46 (inside diameter)
49 Outside cross-sectional dimension of 46 (outside diameter)
50 Wall of 46
51 Enlarged cross-sectional dimension of 32–35
52 Reduced cross-sectional dimension of 32–35
53 First or top end segment support arm
54 Second or bottom end segment support arm
55 Longitudinal axis of pins 20, 28
56 Rotation about 2
57 Rotation about 5
58 1.5"×#10 pan head screws
59 Plastic spacer
60 Wall
61 Door
62 Frame
63 Hinge
64 The like
65 1" plastic ball end caps
66 ⅝" plastic flat end caps
67 Rotational arrow
68 Rotational arrow
69 Phillips head screw
70 Large plastic flat end cap
71 Horizontal section
72 Fixation section
73 Hole
74 Wood screw
X angle
Y angle It is to be understood that the embodiments herein described are merely illustrative of the principles of the present invention and that those skilled in the art can devise various modifications of the mountable hanger apparatus and a kit of parts therefore without departing from the spirit or scope of the claims which follow. It is also contemplated that the parts of the mountable hanger apparatus can be formed from a variety of metal and polymer materials of different lengths and cross-sectional dimensions to meet different needs.

What is claimed is:

1. Mountable hanger apparatus comprising:

an elongated member having a longitudinal axis, a first end segment, an intermediate segment, and a second end segment, all of said segments being separate parts and longitudinally interconnectable along said longitudinal axis, said intermediate segment having first and second end portions each directly interconnectable both rotatably and longitudinally along said longitudinal axis with an end portion of a remaining one of said segments without any other parts interconnecting said segments, a support arm fixedly attachable to said intermediate segment and radially extendable from said longitudinal axis, a first mounting bracket attachable to said first end segment and having a portion fixable to at least one of a wall, door, frame and hinge, and a second mounting bracket attachable to said second end segment and having a portion fixable to at least one of a wall, door, frame, and hinge, whereby said intermediate segment and said support arm are rotatable about said longitudinal axis of said elongated member independent of said end segments when each of said end segments is attached to the at least one of a wall, door, frame and hinge.

2. The hanger apparatus of claim 1, wherein said apparatus further comprises an other intermediate segment having first and second end portions each directly interconnectable both rotatably and longitudinally along said longitudinal axis with the end portion of a remaining one of said segments and wherein said apparatus also further comprises an other support arm fixedly attachable to said other intermediate segment and radially extendable from said longitudinal axis.

3. The hanger apparatus of claim 2, wherein one end portion of each interconnectable pair of said end portions has an outside cross-sectional dimension for insertion into a passageway extending longitudinally in an other end portion of the interconnectable pair of said end portions.

4. The hanger apparatus of claim 1, wherein each of said end portions of said intermediate segment comprises at least one of a male or a female member and each of said end portions of said end segments comprises at least one of an interconnectable female or an interconnectable male member for receiving the at least one of a male or a female member of the end portion of said intermediate segment.

5. The hanger apparatus of claim 1, wherein each of said segments comprises a tubular member having a wall, a passageway extending longitudinally therethrough and an inside and an outside cross-sectional dimension, at least one end portion of an interconnectable pair of said end portions having at least one of an enlarged cross-sectional dimension larger than the outside cross-sectional dimension or a reduced cross-sectional dimension smaller than the inside cross-sectional dimension to rotatably receive an other end portion of the interconnectable pair of said end portions in the passageway thereof.

6. The hanger apparatus of claim 5, wherein one of the end portions of an interconnectable pair of said end portions has a reduced cross-sectional dimension for insertion into the passageway of an other end portion of the interconnectable pair of said end portions.

7. The hanger apparatus of claim 5, wherein one of the end portions of an interconnectable pair of said end portions is swaged for insertion into the passageway of an other end portion of the interconnectable pair of said end portions.

8. The hanger apparatus of claim 5, wherein one of the end portions of each interconnectable pair of said end portions is swaged for insertion into the passageway of an other end portion of the interconnectable pair of said end portions.

9. The hanger apparatus of claim 1, wherein said portion of said first mounting bracket has an opening there-through for insertion of a first door hinge pin through said opening and pivotally attaching said first mounting bracket to a first door hinge; wherein said first mounting bracket has an other portion substantially perpendicular to said portion and having a slot there-through for insertion of a fastener there-through and attaching said first mounting bracket to said first end segment; wherein said portion of said second mounting bracket has an opening there-through for insertion of a second door hinge; and wherein said second mounting bracket has an other portion substantially perpendicular to said portion and having a slot for insertion of a fastener there-through and attaching said second mounting bracket to said second end segment.

10. The hanger apparatus of claim 1, wherein each of said first and said second mounting brackets comprises a first portion and a second portion interconnected to said first portion and having a predetermined angle there-between in a range from 30 degrees to 150 degrees.

11. A kit of mountable hanger apparatus parts comprising:

an elongated member having a longitudinal axis, a first end segment, an intermediate segment, and a second end segment, all of said segments being separate parts and longitudinally interconnectable along said longitudinal axis, said intermediate segment having first and second end portions each directly interconnectable both rotatably and longitudinally along said longitudinal axis with an end portion of a remaining one of said segments without any other parts interconnecting said segments, a support arm fixedly attachable to said intermediate segment and radially extendable from said longitudinal axis, a first mounting bracket attachable to said first end segment and having a portion fixable to at least one of a wall, door, frame and hinge, and a second mounting bracket attachable to said second end segment and having a portion fixable to at least one of a wall, door, frame and hinge, whereby said intermediate segment and said support arm are rotatable about said longitudinal axis of said elongated member independent of said end segments when each of said end segments is attached to the at least one of a wall, door, frame and hinge.

12. The kit of parts of claim 1, wherein the kit of parts further comprises an other intermediate segment having first and second end portions each directly interconnectable both rotatably and longitudinally along said longitudinal axis with the end portion of a remaining one of said segments and wherein said kit of parts also further comprises an other support arm fixedly attachable to said other intermediate segment and radially extendable from said longitudinal axis and an other support arm.

13. The kit of parts of claim 12, wherein one end portion of each interconnectable pair of said end portions has an outside cross-sectional dimension for insertion into a passageway extending longitudinally in an other end portion of the interconnectable pair of said end portions.

14. The kit of parts of claim 11, wherein each of said end portions of said intermediate segment comprises at least one of a male or a female member and each of said end portions of said end segments comprises at least one of an interconnectable female or an interconnectable male member for receiving the at least one of a male or a female member of the end portion of said intermediate segment.

15. The kit of parts of claim 11, wherein each of said segments comprises a tubular member having a wall, a passageway extending longitudinally there-through and an inside and an outside cross-sectional dimension, at least one end portion of an interconnectable pair of said end portions having at least one of an enlarged cross-sectional dimension larger than the outside cross-sectional dimension or a reduced cross-sectional dimension smaller than the inside cross-sectional dimension to rotatably receive an other end portion of the interconnectable pair of said end portions in the passageway thereof.

16. The kit of parts of claim 15, wherein one of the end portions of an interconnectable pair of said end portions has a reduced cross-sectional dimension for insertion into the passageway of an other end portion of the interconnectable pair of said end portions.

17. The kit of parts of claim 15, wherein one of the end portions of each interconnectable pair of said end portions is swaged for insertion into the passageway of an other end portion of the interconnectable pair of said end portions.

18. The kit of parts of claim 11, wherein said portion of said first mounting bracket has an opening there-through for insertion of a first door hinge pin through said opening and pivotally attaching said first mounting bracket to a first door hinge; wherein said first mounting bracket has an other portion substantially perpendicular to said portion and having a slot there-through for insertion of a fastener there-through and attaching said first mounting bracket to said first end segment; wherein said portion of said second mounting bracket has an opening there-through for insertion of a second door hinge; and wherein said second mounting bracket has an other portion substantially perpendicular to said portion and having a slot for insertion of a fastener there-through and attaching said second mounting bracket to said second end segment.

19. The kit of parts of claim 11, wherein each of said first and said second mounting brackets comprises a second portion and a first portion having first and second sections interconnected to said second portion and having a predetermined angle there-between in a range from 30 degrees to 150 degrees.

20. Mountable hanger apparatus comprising:

an elongated member having a longitudinal axis, a first end segment, first and second intermediate segments, and a second end segment, all of said segments being separate parts and longitudinally interconnected along said longitudinal axis, each of said first and said second intermediate segments having first and second end portions each directly attached both longitudinally and rotatably along said longitudinal axis with an end portion of a remaining one of said segments without any other parts interconnecting said segments, first and second support arms fixedly attached to said first and second intermediate segments, respectively, and radially extending from said longitudinal axis, a first L-shaped mounting bracket attached to said first end segment and having a portion fixable to at least one of a wall, door, frame and hinge, and a second L-shaped mounting bracket attached to said second end segment and having a portion fixable to at least one of a wall, door, frame and hinge, whereby each of said intermediate segments and said support arm attached thereto are rotatable about said longitudinal axis of said elongated member independent of said end segments.

* * * * *